US006276444B1

(12) United States Patent
Li

(10) Patent No.: US 6,276,444 B1
(45) Date of Patent: Aug. 21, 2001

(54) PROTECTING DEVICE FOR SEALING OPENINGS OF HEAT TUBE AND METHOD FOR MANUFACTURING THE SAME

(76) Inventor: Jia Hao Li, No. 2, Lane 127, Dang Ke St., Kang Shan Jen, Kao Hsiung Hsien (TW)

( * ) Notice: Subject to any disclaimer, the term of this patent is extended or adjusted under 35 U.S.C. 154(b) by 0 days.

(21) Appl. No.: 09/505,836

(22) Filed: Feb. 17, 2000

(51) Int. Cl.[7] ..... F28F 19/00; F28D 15/00
(52) U.S. Cl. ..... 165/134.1; 165/104.21
(58) Field of Search ..... 165/104.21, 104.26, 165/134.1; 403/23, 12

(56) References Cited

U.S. PATENT DOCUMENTS 2,279,143 * 1/1957 Brooks ..... 165/104.21
3,680,189 * 8/1972 Noren ..... 29/890.032
4,105,814 * 8/1978 Eggert ..... 428/122
4,314,607 * 2/1982 DesChamps ..... 165/166
4,497,363 * 2/1985 Heronemus ..... 165/95
5,642,775 * 7/1997 Akachi ..... 165/104.21
5,704,415 * 1/1998 Suzuki et al. ..... 165/104.26
6,040,562 * 3/2000 Tokumoto et al. ..... 219/530

FOREIGN PATENT DOCUMENTS

0088594 * 5/1983 (JP) ..... 29/890.032

* cited by examiner

*Primary Examiner*—Ira S. Lazarus
*Assistant Examiner*—Tho Van Duong
(74) *Attorney, Agent, or Firm*—Rosenberg, Klein & Lee

(57) ABSTRACT

A protecting device for scaling openings of a heat tube and the method for manufacturing the same are disclosed. After punching the rim of a plate-like or tube-like heat tube, a protecting clamp covers thereon. After the protecting clamp clamps the rim, then glue is filled therein to or it passes through a tin furnace for curing. Another, metal, plastic, or glue can cover the rim so as to be formed as a sealing.

4 Claims, 10 Drawing Sheets

PROTECTING DEVICE FOR SEALING OPENINGS OF HEAT TUBE AND METHOD FOR MANUFACTURING THE SAME

FIELD OF THE INVENTION

The present invention relates to a protecting device for sealing openings of a heat tube and the method for manufacturing the same, and especially to a special device and method for sealing openings of a heat tube or heat plate.

BACKGROUND OF THE INVENTION

The prior art heat tube or heat plate serves as heat transfer element in phase change operation. Since the heat tube 12 is formed by an inner plate 112 and a mask plate 113. The mask plate 113 is two flat plates for clamping from two sides or is placed in a round tube. All these are formed as a basic structure.

Since it is required that the heat tube is operated in a closed body, four corners of a heat plate or two ends of a heat tube must be sealed. Currently, as shown in FIGS. 1 and 2, a punching method is used. A pair of upper and lower molding plates 8 and 9 serve to press the edges 111 of the heat tube or heat plate, as shown in FIG. 1. Even it is pressed with a wave-like shape, and then one side thereof is cut.

The newly generated rim has a good tightness. However, this can not be retained for a long period of time. Therefore, the rim of a heat tube or heat plate must pass through a tin furnace 7 for being adhered with tin material at the rim portion. Thus, the rim is substantially sealed.

However, this prior art way has many defects. Since the rim portion is very thin, only a thin layer of tin is adhered to the rim potion, the fluid therewith in is easy to drain out.

Since pressing the opening for cut away is a temporary sealing, the operation of adding with tin must be performed very rapidly. Sometimes, a cooling device is necessary for dissipating the residual heat from the tin furnace to prevent that the heat tube is damaged. Otherwise, not only the sealing effect is not complete, but also the high temperature of the tin furnace will cause that high temperature and high pressure are formed in the heat tube so as to induce an explosion of the heat tube.

Furthermore, the edge generated from pressing the rim is very thin so that two ends become more acute and the tin adhered to the opening is thin. In the assembling process of the product, workers are possible to be harmed or the heat tube is damaged due to a collision. Moreover, the thin edge is easily deformed. Maybe, in the secondary finishing, such as plating or polishing, it is easy to be damaged due to the thin tin layer.

Therefore, the prior art heat tube or heat plate is necessary to be improved in the process of manufacturing.

Alternatively, as shown in FIG. 3, another machining way is illustrated. As the upper view shown in FIG. 3A, since punching process will induce some acute protrusions 21 at two ends of the heat tube 2. A pair of clamping elements 3 and 5 serves to clamp and fix the heat tube, while another pair of molds 5 and 6 serves to press the heat tube inversely to be formed with tip tapers at two ends, as shown in the lateral view of FIG. 3B, for reducing the width thereof. This way is beneficial to the present invention.

SUMMARY OF THE INVENTION

Accordingly, the primary object of the present invention is to provide a protecting device for sealing openings of a heat tube and the method for manufacturing the same. Low temperature manufacturing method and process are changed. The rim of a heat tube is added with a protecting clamp (protecting cover) so that a round rim is formed. Other than increasing the sealing at the rim portion for increasing the reliability in use, the round rim is beneficial in the subsequent finishing process. Moreover, the assembling worker or user will not be harmed by the edge.

Therefore, it can be performed in an automatic process. A good product is produced. Alternatively, the product is protected well.

Therefore, the present invention provides a protecting device for sealing openings of a heat tube and the method for manufacturing the same. After punching the rim of a plate-like or tube-like heat tube, a protecting clamp covers thereon. After the protecting clamp clamps the rim, then glue is filled thereinto or it passes through a tin furnace for curing. Another, metal, plastic, or glue can cover the rim to be formed as a sealing.

The various objects and advantages of the present invention will be more readily understood from the following detailed description when read in conjunction with the appended drawing.

BRIEF DESCRIPTION OF THE DRAWINGS

FIG. 2 shows the process for pressing the rims at two sides of a prior art heat plate, wherein

FIG. 3 shows a process for modifying the edge of a prior art heat tube, wherein

DETAILED DESCRIPTION OF THE PREFERRED EMBODIMENTS

Figure 1:
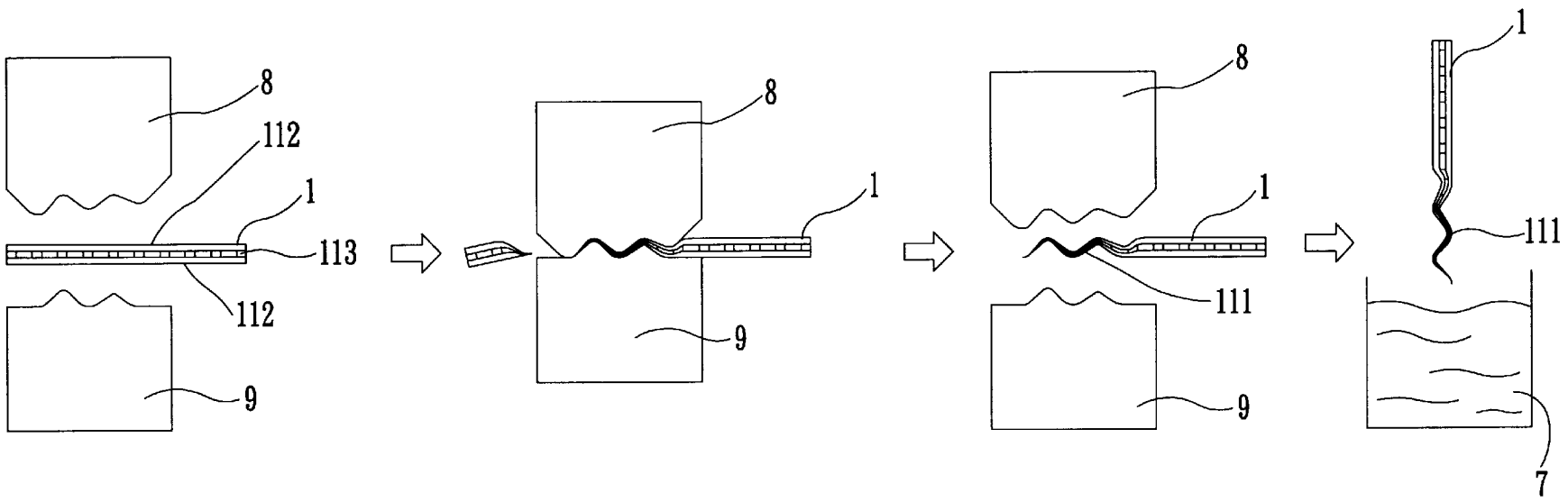
FIG.1 PRIOR ART
FIG. 1 shows the rim pressing process in the prior art heat tube.
Figure 2A:
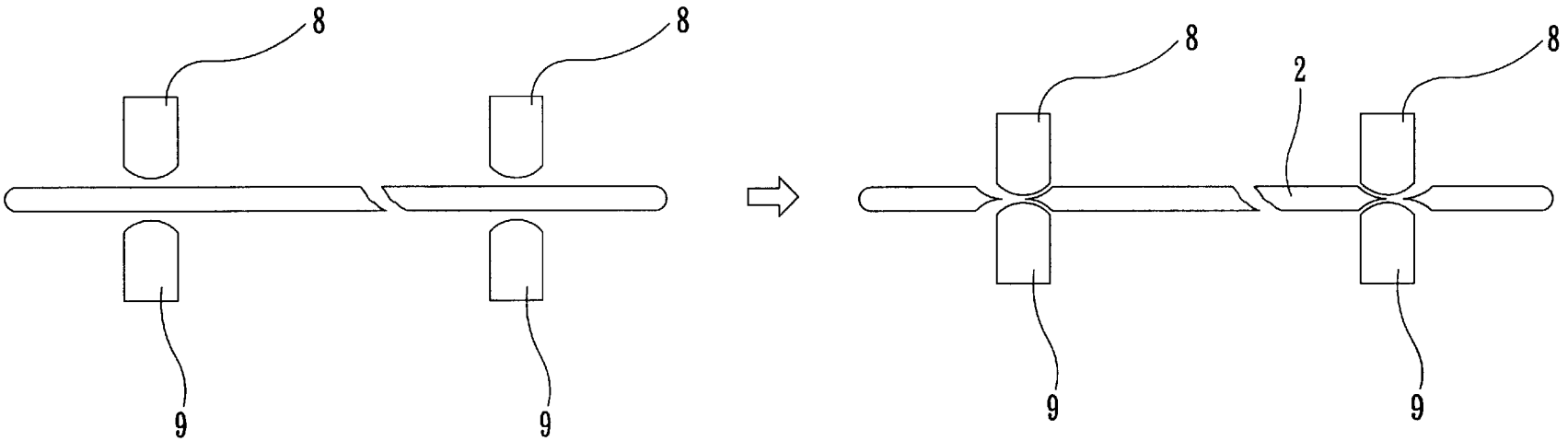
FIG.2A PRIOR ART
FIG. 2A is an upper view of a heat plate.
Figure 2B:
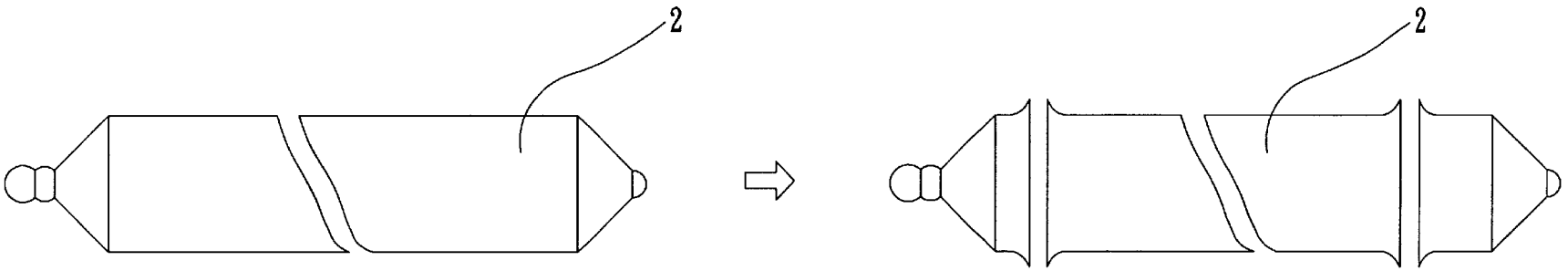
FIG.2B PRIOR ART
FIG. 2B shows a lateral view.
Figure 3B:
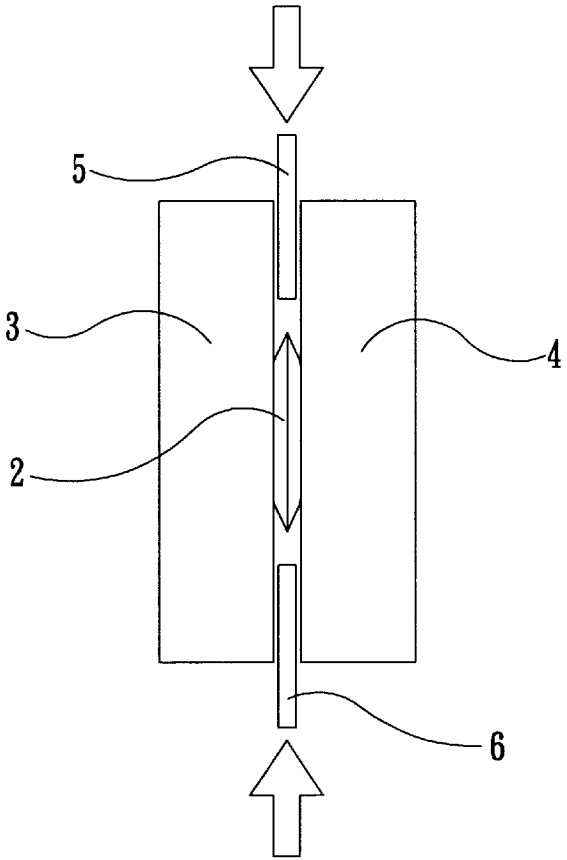
FIG.3B PRIOR ART
FIG. 3A shows an upper view and FIG. 3B shows a lateral view.
Figure 3A:
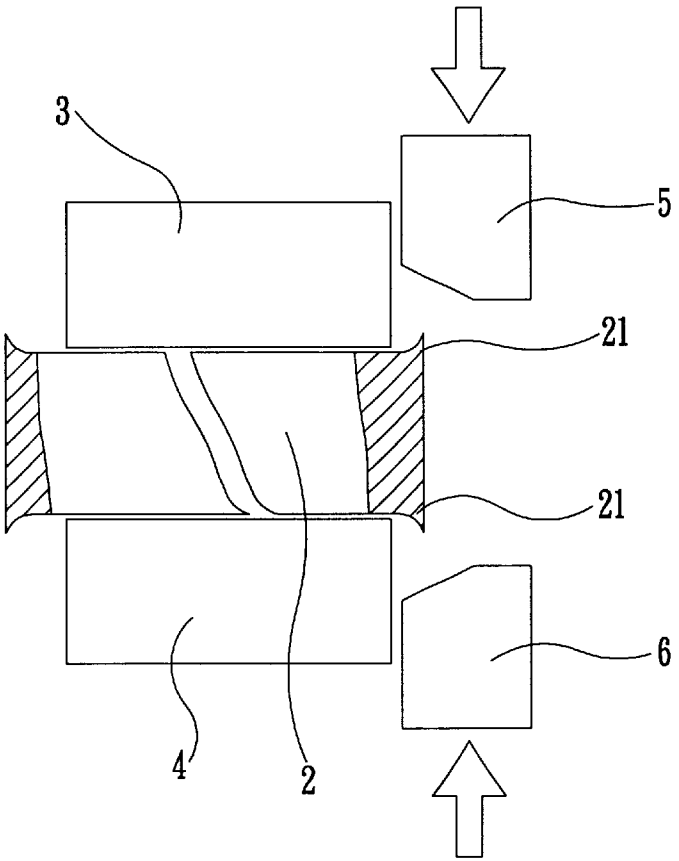
FIG.3A PRIOR ART
Figure 4:
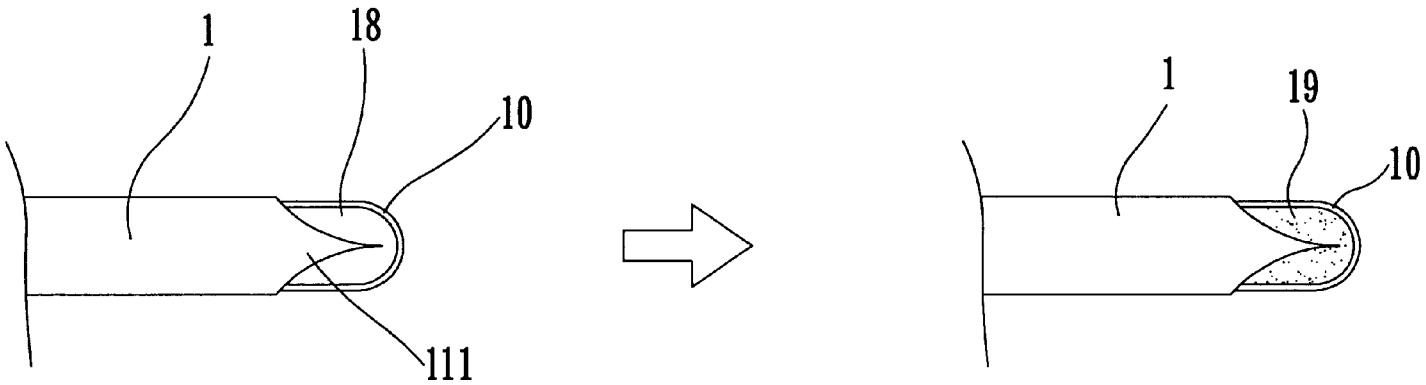
FIG. 4 shows the process of the first embodiment in the present invention.
Figure 5:
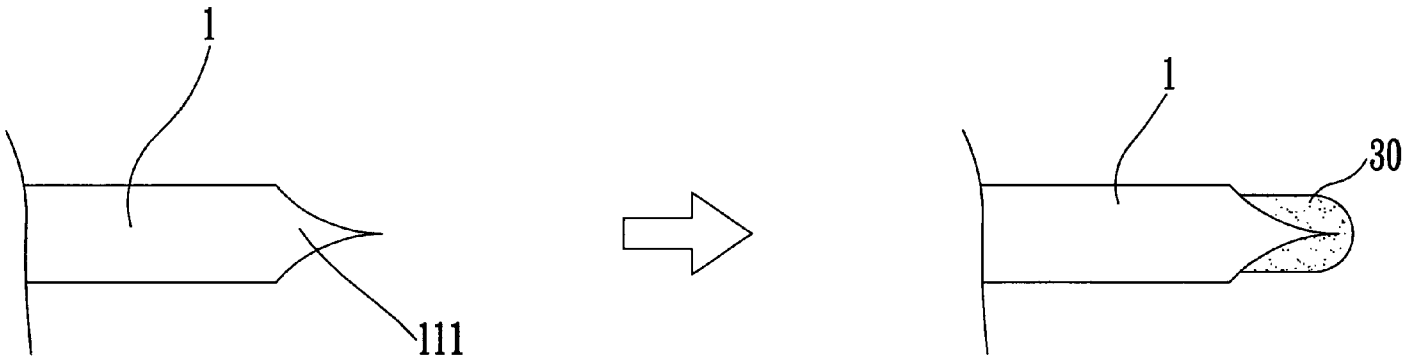
FIG. 5 shows the process of the second embodiment in the present invention.

With reference to FIGS. 4 to 11, the protecting device of a heat tube sealing and the method for manufacturing the same are illustrated. Two ways can be used to embody the present invention. As shown in FIG. 4, in this embodiment, the heat tube 1 has a protecting clamp 10. The heat plate 2 has a protecting cover 20, as shown in FIG. 5. While in another embodiment, at the edge of the heat tube 1 or the heat plate has an integral formed protecting portion.

Since in the present invention, the aforesaid punching breaking process is also used. Now, it is divided into two molds. If a metal protecting clamp or protecting cover made of metal material is used, in manufacturing, the protecting clamp 10 or protecting cover 20 is clamped at the rim 111 of the heat tube 1 or the heat plate 2. Then a dip tin process is used to seal the tube or plate. That is, the rim 111 of the tube or plate clamping the protecting clamp 10 or the protecting cover 20 is placed into tin furnace 7 (referring to another figure), then it is taken out quickly so that the tin liquid is coated on the tin or cover for being filled on the rim.

Another, plastic protecting clamps or protecting covers are used. As in the prior art, it is firstly passed through a tin furnace to be formed with an initial sealing. Then the plastic protecting clamp or protecting cover are clamped in the rim of the tube or plate. Then, glue is filled and then plastic is filled or other viscous material is filled. Since plastics and glue have curing property, they can fill into the full space between the inner surface of the protecting clamp or protecting cover. It is identical to the action of dip tin, the low temperature metal can be filled therein. Aforesaid is the embodiment of the protecting clamp or protecting cover with practical looks.

The protecting clamp (protecting cover) can be a type without practical outlooks, as shown in FIG. 5. After the heat tube is initially passed through the tin furnace, by mold pressing, a metal sealing material serves to press the rim. Other pressing material, such as plastics or glue can be used. That is, no clamp or cover is used. However, in finishing process, the temperature must be carefully controlled. Thus, the rim of the heat tube or heat plate of a protecting structure is easily clamped by a protecting clamp or protecting cover.

Figure 6:
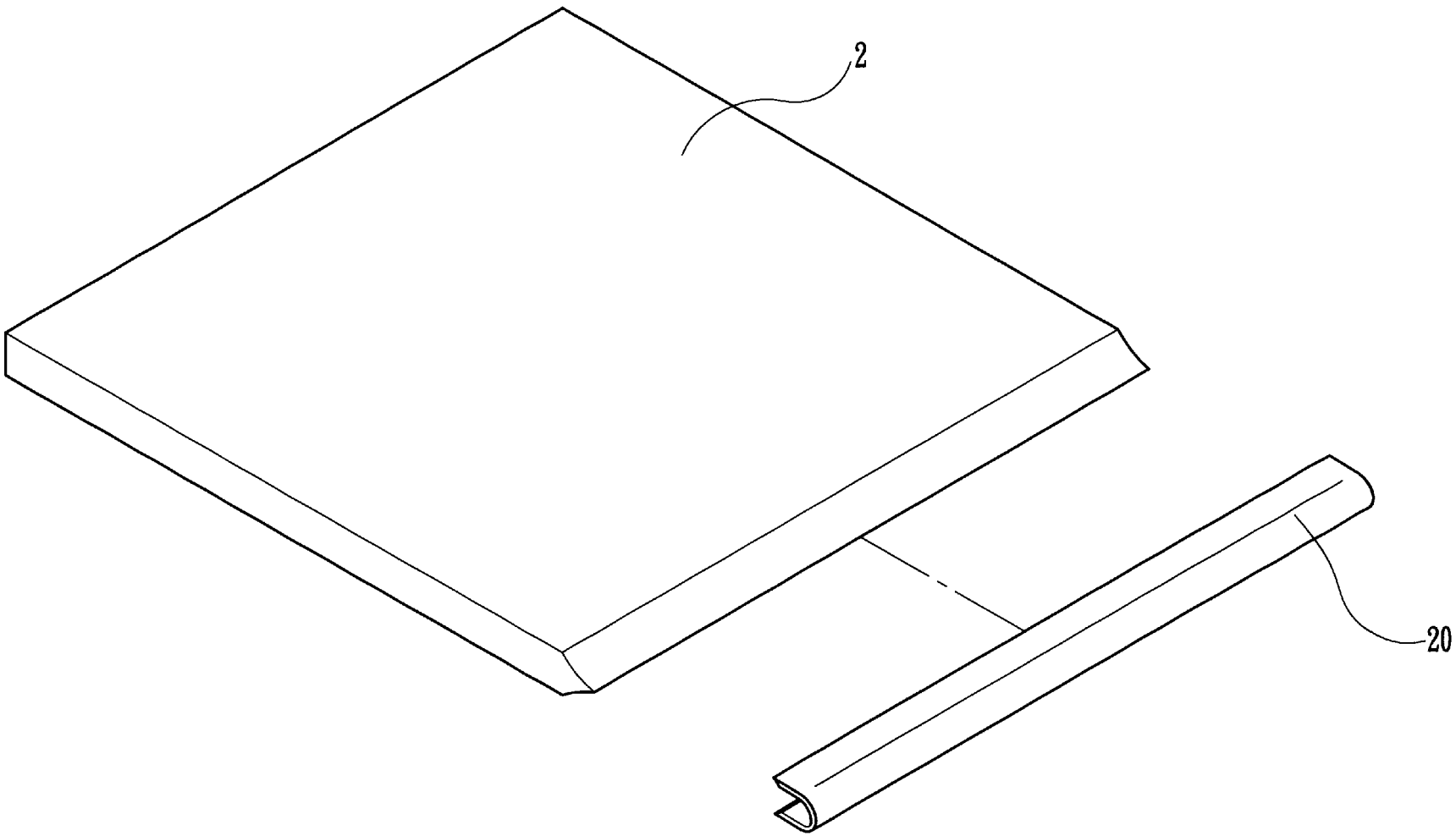
FIG. 6 is a perspective view showing that the present invention is used in the heat plate.
Figure 7:
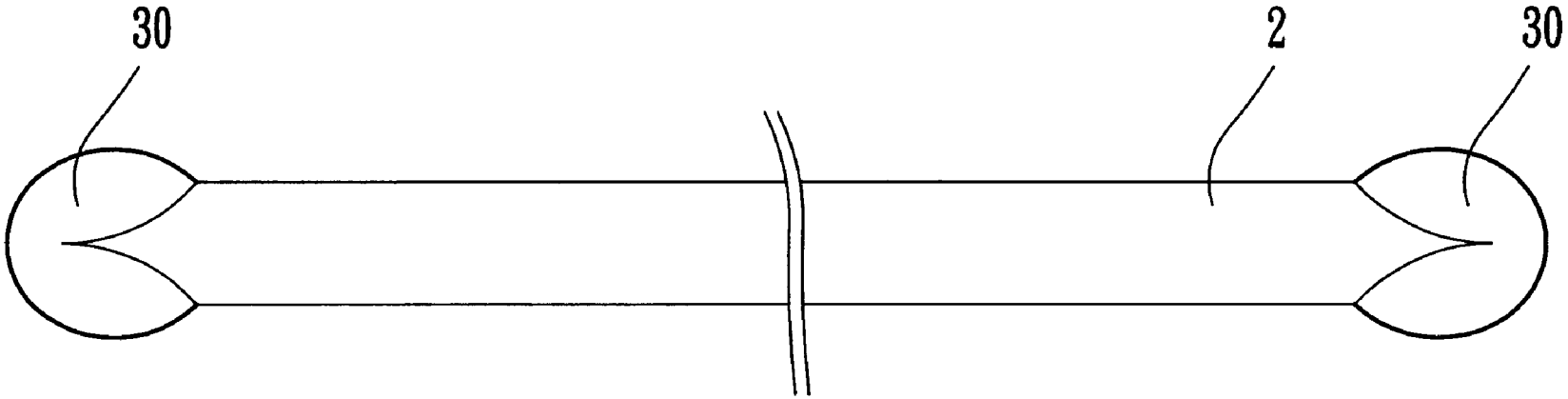
FIG. 7 is a lateral view showing that the present invention is used at two edges of a heat plate.

The FIGS. 6 and 7 show the embodiments of heat plate, these embodiments are identical to that shown in FIGS. 4 and 5 which shows the embodiment of a heat tube.

Figure 8:
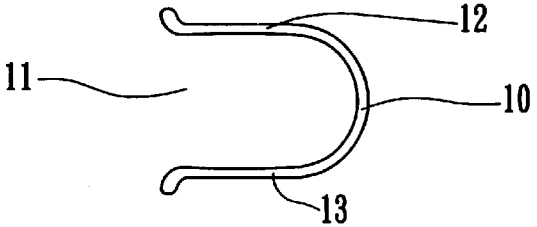
FIG. 8 is a first lateral view of the protecting clamp according to the present invention.
Figure 9:
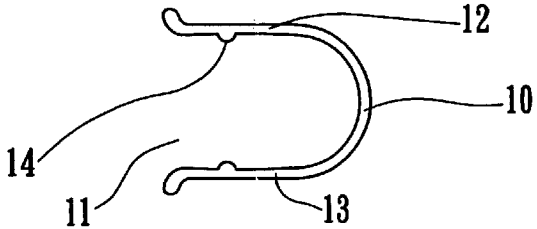
FIG. 9 is a second lateral view of the protecting clamp according to the present invention.
Figure 10:
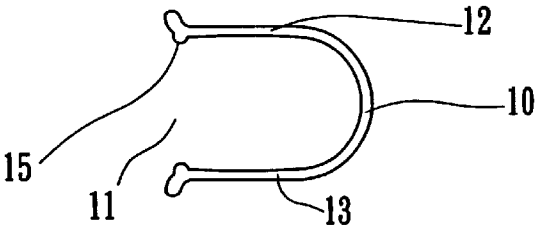
FIG. 10 is a third lateral view of the protecting clamp according to the present invention.

The protecting clamp 10 has three different types as that shown in FIGS. 8 to 10. The protecting clamp or protecting cover in the present invention has the function of clamping an object. Moreover, the height of the protecting clamp or the protecting cover will not large than the width of the heat plate or the heat tube. Furthermore, as shown in FIG. 8, as it is presented as a clamp and has an opening 11. The opening 11 is an outward inclined V shape. The protecting clamp 10 has a holding effect. Then, the shape of the two pieces 12 and 13 of the protecting clamp is bent as an arc for generating a clamping force. Thus, the protecting clamp 10 can be buckled to the rim. In order to increase the buckling effect, as shown in FIG. 9, convex points 14 could be installed at the inner side of the opening. Or, as that shown in FIG. 10, convex points 15 can be directly installed at the opening. The convex points 14 and 15 can be used to generate a preferred clamping effect. Since the heat tube has a smaller width, it can be performed easily as it is sunk in liquid or filled by glue or tin.

Figure 11:
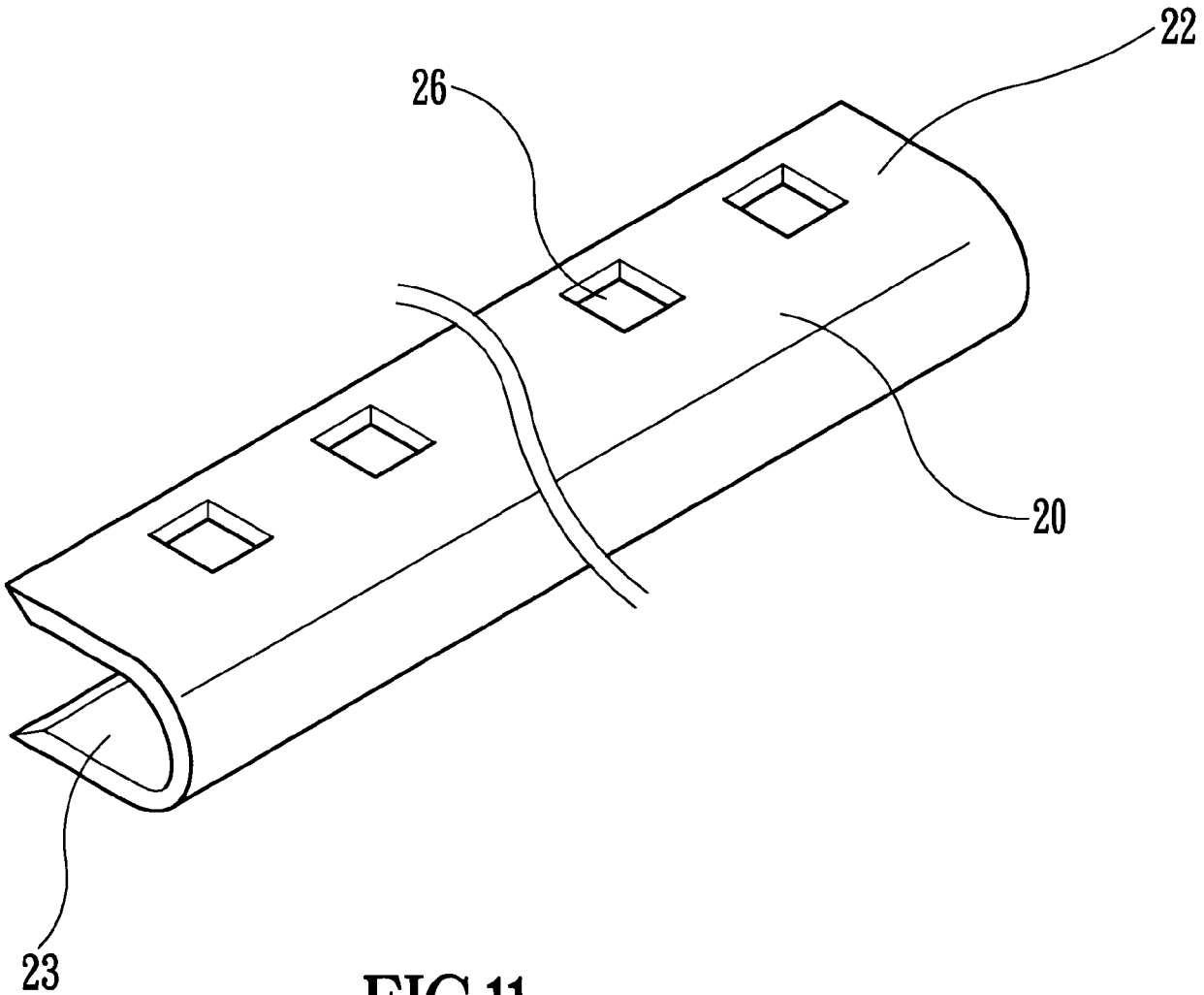
FIG. 11 is a fourth lateral view of the protecting clamp according to the present invention.

Since the heat plate has a large width, the required protecting cover 20 must have a longer length, similarly, it has two piece bodies 22 and 23. As it is sunk in a liquid, or is filled with filling material, the material can not filled to each corners, as shown in FIG. 11, a plurality of through holes 26 spaced with an equal space are disposed on the two piece bodies 22 and 23. Therefore, the filling material, glue or tin, could flow into the space not only from the two ends, but also from the through holes. Then the contact time with the tin furnace is reduced so that the fill process is more successful with a quick speed.

Figure 12:
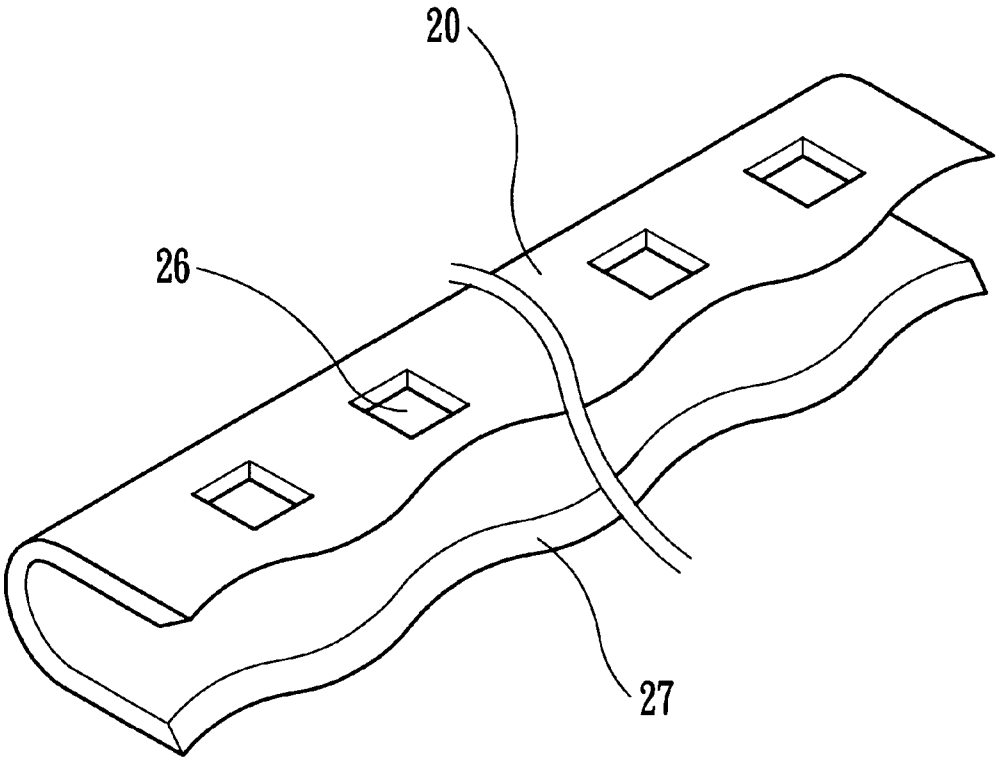
FIG. 12 is a fifth lateral view of the protecting clamp according to the present invention.

As shown in FIG. 12, the areas near the openings of the piece bodies 22 and 23 of the protecting clamp or protecting cover are formed as a wave-like shape 27 for increasing the clamping force.

From the aforesaid structure and manufacturing process, in the present invention, a protecting clamp, or a protecting cover, or a protecting portion is added to protect the rims of a heat tube or heat plate, other than the tip edge or acute portion at the rim of a heat tube or a heat plate is reduced. Moreover, the manufacturing process is more successful and convenient. That is, each heat tube or heat plate can be made more complete and the sealing and safety in using is increased with a slight increment in the cost and manufacturing process. Moreover, due to the structure of the present invention, the subsequent finishing and the requirement in assembly of a heat tube or a heat plate is reduced so as to provide a well protection. Furthermore, the operators or users are prevented to be harmed. Therefore, the whole quality and yield ratio are increased. An automatic process can be performed in the present invention. Therefore, the price of the product is reduced and the product has a longer lifetime. It is appreciated that in the prior art, it must performed with a cooling equipment. However, this is improved by the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A protecting device for sealing an opening of a heat tube comprising a heat tube having an outer rim formed by a punching and cutting process, a protecting clamp engaged to said outer rim, and a filling material filling an interior space of said protecting clamp, said protecting clamp having a pair of side pieces, each of said side pieces being bent in an arc shape for clamping said outer rim, said pair of side pieces of said protecting clamp defining an opening therebetween, said opening being in open communication with said interior space, said side pieces being formed with convex points extending therefrom for enhancing a clamping force of said protecting clamp.

2. The protecting device for sealing an opening of a heat tube as claimed in claim 1, wherein said convex points of said side pieces of said protecting clamp respectively extend from an inner side of said side pieces spaced from said opening.

3. A protecting device for sealing an opening of a heat plate comprising a heat plate having an rim formed by a punching and cutting process, a protecting cover engaged to said rim, and a filling material filling an interior space of said protecting cover, said protecting cover having a pair of side pieces, each of said side pieces being bent in an arc shape for clamping said rim, said pair of side pieces of said protecting cover defining an opening therebetween, said opening being in open communication with said interior space, said side pieces being formed with convex points extending therefrom for enhancing a clamping force of said protecting cover.

4. The protecting device for sealing an opening of a heat plate as claimed in claim 3, wherein said convex points of said side pieces of said protecting cover respectively extend from an inner side of said side pieces spaced from said opening.

* * * * *